US006067717A

United States Patent [19]

Perlman et al.

[11] Patent Number: 6,067,717

[45] Date of Patent: May 30, 2000

[54] COMBINATION UTENSIL TOOL

[75] Inventors: Richard W. Perlman, Falls Church; John Michael Mitchell, Herndon, both of Va.

[73] Assignee: Immix, LLC., Fairfax, Va.

[21] Appl. No.: 09/097,247

[22] Filed: Jun. 12, 1998

[51] Int. Cl.[7] ..... A47J 43/28

[52] U.S. Cl. ..... 30/142; 30/147; 30/148; 30/149

[58] Field of Search ..... 30/142, 147–150, 30/307, 319, 329, 340, 322, 324

[56] References Cited

U.S. PATENT DOCUMENTS

| | | | |
|---|---|---|---|
| 44,699 | 10/1864 | Bayley . | |
| 96,134 | 10/1869 | McMorries . | |
| D. 286,608 | 11/1986 | Leung | D7/106 |
| 456,784 | 7/1891 | Varell | 30/149 X |
| 708,806 | 10/1902 | Garda . | |
| 1,288,617 | 12/1918 | Kupiszewski | 30/149 X |
| 1,306,783 | 6/1919 | Smolinsky | 30/307 X |
| 2,038,197 | 4/1936 | Pruitt | 107/47 |
| 2,311,107 | 2/1943 | De Fraties | 30/148 |
| 2,568,353 | 9/1951 | Miseta | 30/142 X |
| 4,771,541 | 9/1988 | Bouchakian | 30/148 |
| 4,825,552 | 5/1989 | Bendickson et al. | 30/340 X |
| 5,699,614 | 12/1997 | Garneau | 30/142 |

OTHER PUBLICATIONS

Fred Sammons, Sammons Your Complete Source for Orthopedic and ADL Products Catalog 1994, pp.12–20.

Apothecary Products, Inc. Gripmate Instructions, 1992.

Maddak Inc. Ableware Instructions, Mar. 1990.

*Primary Examiner*—Douglas D. Watts

*Attorney, Agent, or Firm*—Roberts Abokhair & Mardula, LLC

[57] ABSTRACT

A combination utensil tool with attachable utensils, such as forks, spoons, and knives which are easy to attach and detach from a common handle. The present invention comprises a built up contoured handle preferably having a raised rim on a first end and a downward extending lip on a second end. Attached to the first end of the handle is a shaft having a roller knife (or other type of knife) attached thereto. The roller knife enables the user to cut food with the use of one hand. Attached to the second end of the handle is either a spoon, fork or knife (collectively known as a utensil). The utensil comprises a shaft having a head and a notch. The shafts of the utensils are either straight or have an upward or downward angled bend in order to allow the user to eat with minimal wrist movement. The utensil is firmly coupled to the second end of the handle by a spring loaded release mechanism comprising a rod having a downward projection which permits the user to attach and detach several utensil to the handle.

35 Claims, 10 Drawing Sheets

COMBINATION UTENSIL TOOL

FIELD OF INVENTION

The present invention relates generally to an eating utensil which combines various eating utensils into a single unit. More particularly, the present invention is a combination eating utensil tool which combines several eating utensil heads such as a fork head, a knife head, and a spoon head into a single eating utensil unit having a common handle for those individuals who are unable to use both hands to manipulate utensils.

BACKGROUND AND DESCRIPTION OF RELATED ART

Millions of people world wide suffer from disabling injuries and crippling diseases such as arthritis, Parkinson Disease, and Torsion Dystonia to name but a few. These disabilities make every day tasks such as eating a meal extremely difficult, if not impossible. For example, an individual with an advanced case of Torsion Dystonia or Parkinson Disease suffers from uncontrollable muscle spasms and other neurologic deficits that make holding and properly manipulating a fork and a knife impossible.

In cases such as those mentioned above, the afflicted individual requires certain products (e.g. "aids") in order to lead a fulfilling life and, as important, retain their self sufficiency and pride. Over the years many people have devoted their lives to developing such aids for disabled individuals. These aids range from artificial limbs to specially designed eating utensils, such as over-sized forks and knifes. Specially designed eating utensils have also been devised to benefit those individuals with weakened hands, limited dexterity, or other difficulties in grasping utensils with their hands. In essence, these utensils have restored the ability of many disabled individuals who were previously unable to eat a basic meal without the assistance of a third party.

Several manufacturers have developed large grip utensil handles so that individuals with weak hands can grasp the utensils. These utensils, however, are not well suited for those individuals who have the use of only one hand or arm (due to injury or other disability). In these cases, the individual with one hand still suffers from the inability to use two utensils simultaneously, thus still having to rely on others to prepare their food prior to eating (i.e. many disabled individuals rely on others to cut their food prior to them eating because they are unable to do it by themselves).

Several manufacturers, such as Sammons™, manufacture a complete array of orthopedic products for assisting individuals of varying disabilities. These products include home care products, personal care products, and dining accessories. In the case of dining accessories, Sammons™ has produced a full line of cutlery for disabled persons. These eating utensils include, among others, (i) adjustable swivel utensils for those individuals who lack wrist or finger motion, (ii) vertical and horizontal palm utensils which allow the hand in "mid-position" to function in a table-to-mouth pattern, (iii) offset combination forks and spoons (e.g. "sporks") that combine the use of a spoon and a fork into one unit for those individuals with limited wrist motion, (iv) adjustable utensils with an EZ Grasp™ handle that facilitates independent eating for those individuals with limited hand function or weakness, and (v) a roller knife having a built-up ergonomic handle for one handed use. As seen, Sammons™ does not combine several utensil heads into a single unit having a common handle for disabled persons having only the use of one hand.

Other manufacturers have also developed orthopedic dining accessories to assist disabled persons. For instance, Ableware® has developed adjustable built-up utensils. These utensils comprise two semi-circular handle portions that combine to form a circular handle. Rings are placed over the circular handle to hold the two semi-circular portions together. Placed between the two semi-circular portions is a utensil. To disassemble the unit, the rings are slid off the circular handle and the two semi-circular portions are pulled apart. Thereafter, a utensil can be taken out and a different utensil put in its place. The problem with this utensil, however, is that only one utensil can be used at a time. Further, in order to assemble and disassemble this utensil two hands are needed; one hand to slide off the rings and another hand to spread apart the circular handle and replace the utensil. Thus, this utensil clearly does not meet the needs of all disabled individuals, and in fact, appears to be useful for only those individuals who need a built-up grip due to weak hands.

Apothecary Products, Inc.® produces Gripmate™ products to assist disabled persons. These products range from doorknob extensions to Comfort Grip™ forks and spoons. With regard to the Comfort Grip™ forks and spoons, a built-up handle is placed about the fork and spoon handle. This device does not combine several utensils together for easy use with one hand.

Several inventors have also attempted to developed specially designed utensils. These specially designed utensils, though, do not appear to be directed to those individuals with disabilities. For example, U.S. Pat. No. 708,806 to G. Garda discloses a folding knife and fork suitable for campers and soldiers. This device comprises a hollow base handle, a folded fork, and several knives. The fork is pivotally mounted on the handle and folds into a pocket in an outer end of the handle. When the fork is in use, it is detached from the handle and unfolded. The knives are also pivotally mounted on the handle, but they fold into a hollow center of the handle. This tool does not have any specially designed handle for individuals with weak hands or other disabilities.

U.S. Pat. No. 2,038,197 to W. Pruitt discloses an improved knife having a knife and a fork means. The fork serves as a pricking means and a hook means for pulling a food to the front of an oven when it is being baked. The fork and knife are attached to the handle by rivets. There is no mention of attachable utensil heads or a built up handle. Additionally, there is no mechanism to protect one's hand from being cut by the knife if it slips from the handle.

U.S. Pat. No. 2,311,107 to C. A. DeFraties discloses a utility pocket knife wherein a retractable fork and knife are disclosed. Another combination fork and knife tool is disclosed in U.S. Pat. No. 4,771,541 to Bouchakian wherein a fork having a plurality of tines (e.g. fork) and a cutting edge integrally molded into an outer tine is disclosed. A standard handle (i.e. not built-up) having a tabbed structure opposite to the integrally molded cutting edge is also disclosed.

All of the above references use mechanisms that do not address the needs of a disabled person having the use of only one hand. What is needed to meet the needs of these individuals is a utensil that has several utensil heads attached to a common handle that is easy to manipulate and use. This utensil would include removable utensil heads, such as forks, knives, and spoons that can be easily interchanged by the user. This utensil would be easy to assemble and disassemble without the need for special tools, skills or other assistance, and would also be inexpensive to manufacture. Additionally, the utensil would be constructed so that all constituent components are securely fixed to one another utilizing a simple design fashioned for easy assembly and disassembly. In order to accomplish the above, the removable utensil heads would have a fastening assembly which engage notches or other mechanisms on the utensil.

SUMMARY OF THE INVENTION

It is therefore an object of the present invention to provide a combination eating utensil that combines a cutting means with several utensil heads, such as fork heads and spoon heads into a one piece unit having a common handle.

It is an object of the present invention to provide a combination eating utensil that has a built-up handle grip.

It is a further object of the present invention to provide a combination eating utensil that has a lightweight and contoured handle.

It is still a further object of the present invention to provide a combination eating utensil that assists disabled persons with weakened hands, limited dexterity, or other disabilities.

It is another object of the present invention to provide a combination eating utensil that is easy to assemble and disassemble.

It is still another object of the present invention to provide a combination eating utensil that is inexpensive to manufacture.

It is also an object of the present invention to provide a combination eating utensil that can be used to conveniently cut food using overhand and then use the same utensil to consume that food using the same or a single for all functions.

These and other objects and advantages of the present invention will be apparent to those of ordinary skill in the art upon inspection of the detailed description, drawings, and appended claims.

The combination utensil tool ("the present invention") is directed towards a utensil comprising a common handle and attachable forks, spoons, and knives which are easy to attach and detach from the common handle. This permits the user to operate the present invention with the use of one hand, thus eliminating the need for third party assistance and further allowing the user to manipulate and control several separate utensils simultaneously.

The present invention comprises a contoured handle preferably made from a pliable rubber or foam material for easy graspability. Integrally molded into a first end of the handle is a raised rim which prevents the user's hand from slipping off the handle. Integrally molded into a second end of the handle is a downward extending lip which again prevents the user's hand from slipping off the handle.

Attached to the first end of the handle is a shaft having a roller knife attached thereto. The roller knife enables the user to cut food with the use of one hand. Located on the roller knife shaft is a safety guard which prevents the user's hand from slipping onto the cutting blade, thereby resulting in serious hand injuries. Attached to the opposite (or second) end of the handle is either a spoon or a fork (collectively known as utensils). In the preferred embodiment the utensil is larger than the standard utensil head, although this is not a limitation.

The utensil is firmly coupled to the second end of the handle by a spring loaded release mechanism which permits the user to attach and detach any one of several utensils to the handle. In order for the utensil to be firmly coupled with the handle a bore is placed within the handle.

The utensil head comprises a shaft having a head and a notch. In the preferred embodiment, the shaft is fitted into the bore located at the second end of the handle. The release mechanism then engages the notch. The shafts of the utensils are either straight or have an upward or downward angled bend in order to allow the user to eat with minimal wrist movement. The upward bend allows a left handed user to utilize the present and a downward bend allows a right handed person to utilize the present invention.

In the preferred embodiment the release mechanism is spring loaded. The release mechanism generally comprises a rod having a downward projection. This projection engages the notch of the utensil. The release mechanism is directed by a guide which permits the release mechanism to travel in a defined path preferably perpendicular to the attached utensil. A stopper is also provided on the release mechanism in order to insure that the release mechanism does not extend past the guide and deviate from the defined path.

In order to firmly attach the utensil to the handle the bore and release mechanism are utilized. To attach the utensil to the handle the user guides the utensil into the bore of the handle until the downward projection of the release mechanism engages the notch of the utensil. To detach the utensil from the handle the user depresses the release mechanism which, in turn, disengages the downward projection from the notch of the utensil. The user then removes the utensil from the bore of the handle. The release mechanism automatically returns to its original position.

BRIEF DESCRIPTION OF THE DRAWINGS

FIG. 10B shows a fork/spoon, FIG. 10C showing a fork/knife, and FIG. 10D showing a fork/knife/spoon.

DETAILED DESCRIPTION OF THE INVENTION

The present invention is directed towards a combination eating utensil tool comprising a common handle with first and second ends with attachable forks, spoons, and knives (collectively "utensils") which are easy to attach and detach from the common handle. The dimensions of the present invention, including length, width, shape, and other variables and quantities specified herein may vary with the type of utensil tool contemplated. Therefore, numbers and dimensions specified herein are not to be construed as limitations on the scope of the present invention. These numbers and dimensions are meant to be merely illustrative of one particular embodiment.

The present invention is a utensil that is designed to have attachable forks, knifes, and spoons attached to the common handle. In addition, the present invention is capable of being easily assembled and disassembled by the user without the need of any special equipment, skill, or assistance by a third party.

The use of attachable utensils allows the user, typically disabled users, to eat a meal without the assistance of a third party. This is accomplished by separately producing several attachable utensils and combining at least two of them by inserting them in opposite ends of the common handle. This permits the user to operate the present invention with the use of one hand, thus eliminating the need to manipulate and control several separate eating utensils simultaneously.

The following combinations are a sample of various utensil combinations:

(i) a spoon and a knife;

(ii) a fork and a knife; and (iii) a fork and a spoon.

Other embodiments will be obvious to those skilled in the art. These embodiments include combining several utensils together, such as a spoon, a fork, and a knife, on a common utensil tool.

The present invention is designed from any material that is suitable for this purpose and which provides strength, easy graspability, and support for the user. It is preferred that a pliable rubber is used for the handle surrounding a steel or other rigid core and steel or other suitable material is used for the utensils. Foam rubber or other supple material may also be used for the handle. The shape of the present invention will vary in accordance with its numerous applications as previously illustrated.

Figure 1A:
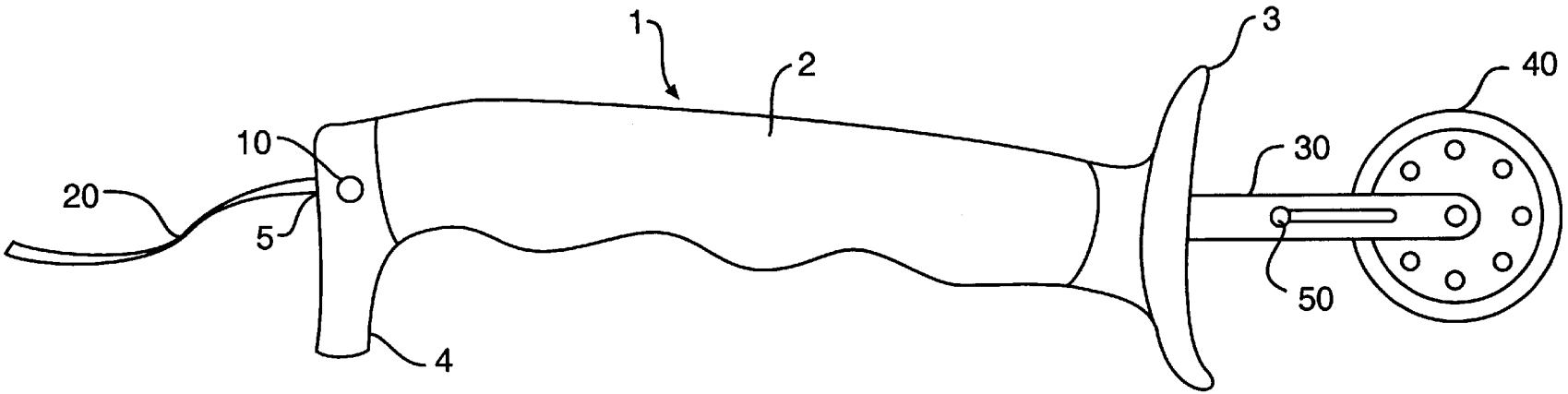
FIG. 1A shows a perspective view of a utensil tool with a roller blade arrangement.
Figure 1B:
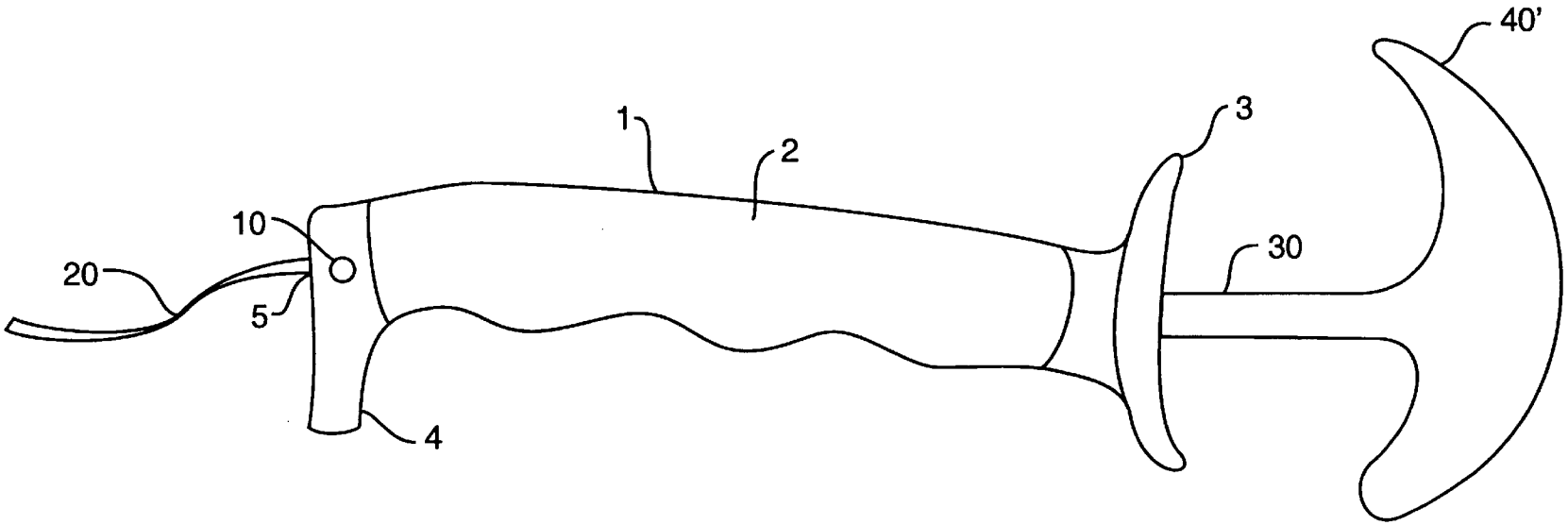
FIG. 1B shows a perspective view of a utensil tool with a rocker blade arrangement.

FIGS. 1A–1B show a perspective view of a utensil tool, generally designated 1. The utensil tool 1 comprises a handle 2 having a first end and a second end. The handle 2 is preferably contoured (e.g. shaped to fit the user's fingers comfortably) and built up so that a user can easily grasp the utensil tool 1. Integrally molded into the first end of the handle 2 is a raised rim 3 around the circumference of the handle 2. This rim 3 prevents the user's hand from slipping off the handle 2 and further acts as a guard against the user cutting himself on a utensil head or other similar mishap.

Attached to the first end of the handle 2 is a shaft 30. Connected to the leading edge of the shaft 30 is a circular roller knife 40. The circular roller knife 40 enables the user to cut food with the use of one hand only. A rocker knife 40' is also contemplated for use by the present invention. The circular roller knife 40 is detachable. In the preferred embodiment leading edge of the shaft 30 comprises two projections, wherein the circular roller knife 40 is removably mounted between the two projections by a hex nut (detailed in FIG. 2*b*).

Located on the shaft 30 at a certain distance between the first end of the handle 2 and the circular roller knife 40 is a safety guard 50. This safety guard 50 acts as a shield in case the user's hand slips from the handle 2, thus preventing serious injury. In the preferred embodiment the shaft 30 and circular roller knife 40 are permanently mounted to the first end of the handle 2, however, alternate embodiments envision a detachable shaft 30 and/or circular roller knife 40 combination.

Integrally molded to the second end of the handle 2 is a downward extending lip 4. This downward extending lip 4 prevents the user's hand from slipping off the handle 2 and further acts as a protector against the user cutting their hand on a utensil head or other similar mishap. Attached to the second end of the handle is a utensil generally designated at 20. This utensil 20 can be a spoon or a fork (collectively known as a utensil). In the preferred embodiment the utensil 20 is larger than the standard utensil head, however, a standard sized utensil head is also contemplated for use with the present invention.

Figure 6:
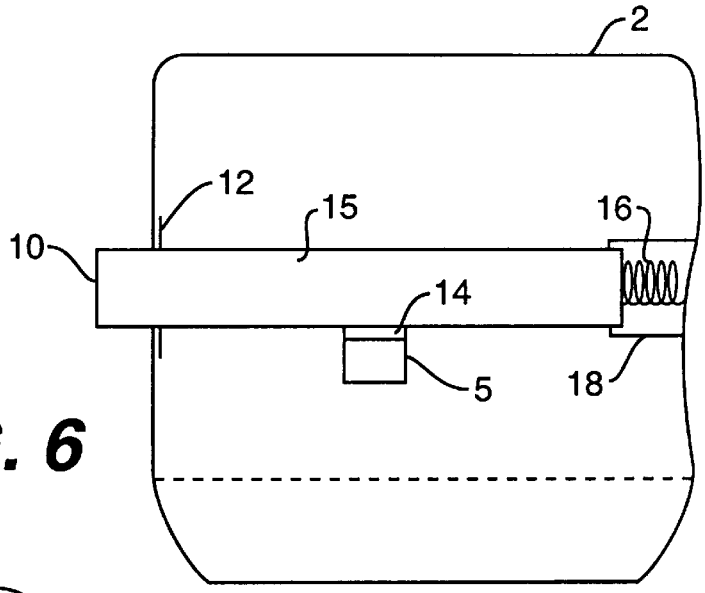
FIG. 6 shows a front view of the handle.

The utensil 20 is firmly coupled to the second end of the handle 2 by a release mechanism 10. This release mechanism 10 permits the user to attach and detach several utensils 20 to the handle 2. In the preferred embodiment, the release mechanism 10 is a spring loaded mechanism as further explained below. In order for the utensil 20 to be firmly coupled to the handle 2 a bore 5 is placed within the handle 2 as seen in FIGS. 2 and 6.

Figure 2:
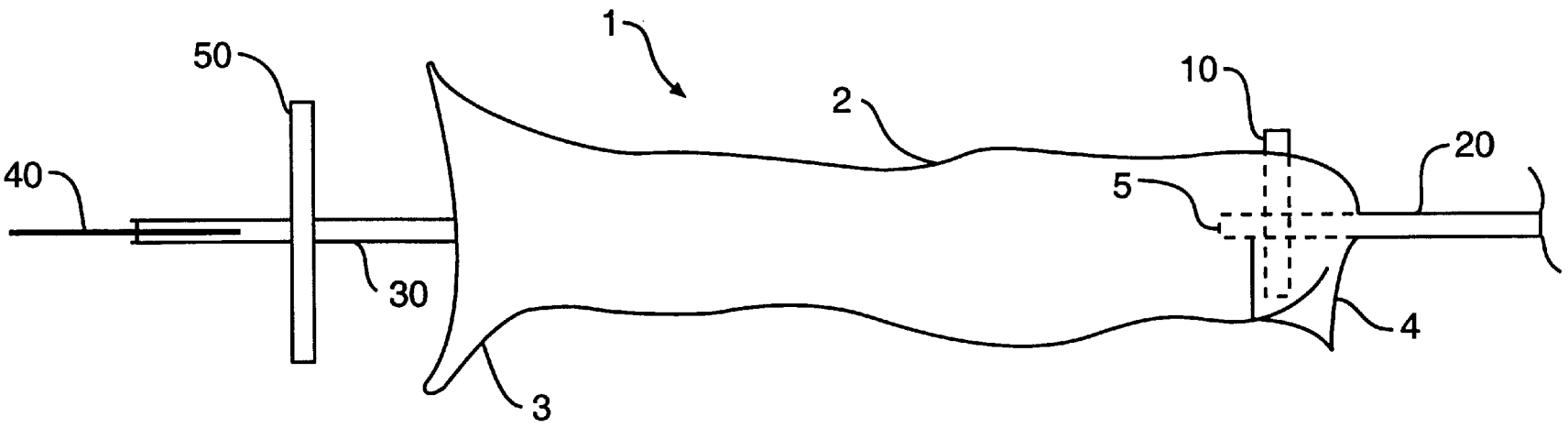
FIG. 2 shows a top view of the utensil tool.

FIG. 2 shows a top view of the utensil tool 1. As seen in this embodiment, the utensil tool 1 comprises a built up contoured shaped handle 2. This handle allows the user to easily and firmly grasp the handle 2. Integrally molded on the first end of the handle 2 is a raised rim 3 around the circumference of the handle 2. Attached to the first end of the handle 2 is a shaft 30. Rotatably mounted to the leading edge of the shaft 30 is a circular roller knife 40. Other knives, such as a contoured rocker knife (not shown), are also envisioned. Located on the shaft 30 is a safety guard 50 which prevents the user's hand from slipping off the handle 2 and onto the circular roller knife 40 and causing serious injury. In the preferred embodiment, the shaft 30 and circular roller knife 40 are permanently mounted to the handle 2.

Integrally molded to the second end of the handle 2 is a downward extending lip 4 which prevents the user's hand from slipping off the handle 2 and further acts as a guard against the user cutting himself on a utensil head. Attached to the second end of the handle is a utensil generally designated at 20. This utensil 20 is either a spoon, fork, or knife. The utensil 20 is firmly coupled to the second end of the handle 2 by a release mechanism 10 as detailed below. A bore 5 is placed within the second end of the handle 2 so that the utensil 20 can be placed therein.

Figure 2A:
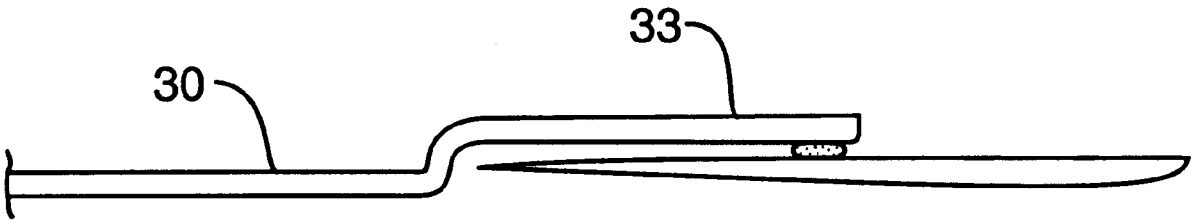
FIG. 2*a* shows a shaft and a circular roller blade.

FIG. 2*a* shows the shaft 30 and circular roller blade 40. In the preferred embodiment the leading edge of the shaft 30 comprises a stepped projection 33 at its leading edge, wherein the length of the step is slightly larger than the radius of the circular roller knife 40 and the depth of the step is slightly larger than the width of the circular roller knife 40. In this embodiment, the circular roller knife 40 is removably mounted to the leading edge of the stepped projection 33 by a hex bolt or other fastening means. As seen, the circular roller knife 40 is slightly recessed in relation to the raised portion of the stepped projection 33, thereby eliminating the possibility of serious hand injury if the user's hand falls off the handle 2.

Figure 2B:
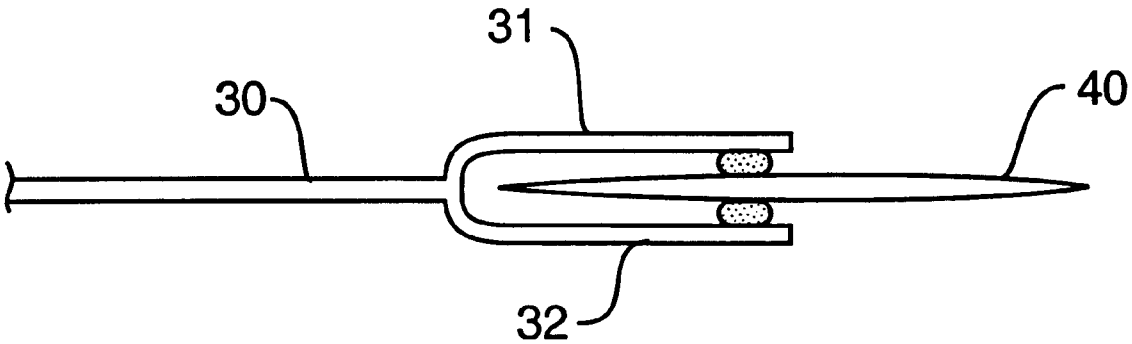
FIG. 2*b* shows a shaft and a circular roller blade.

FIG. 2*b* shows an alternate embodiment of the shaft 30, whereby the shaft 30 comprises an upper and lower projection 31 and 32, respectively. The circular roller knife 40 is removably mounted between the upper and lower projections 31 and 32 by a hex nut or other fastening means.

Figure 3:
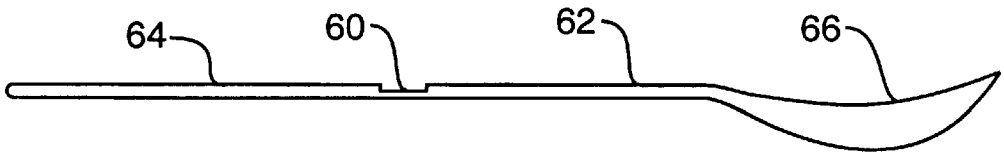
FIG. 3 shows a side view of a spoon.
Figure 3A:
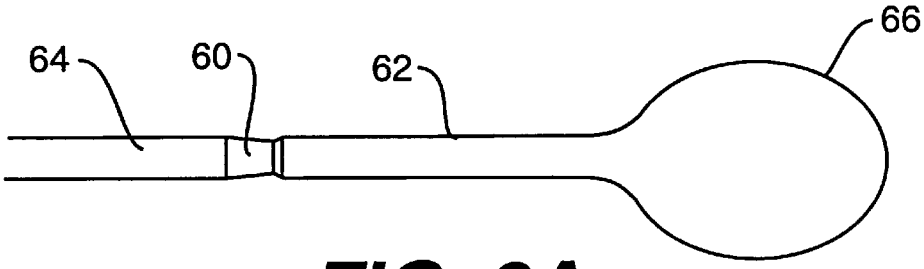
FIG. 3*a* shows a top view of a spoon.
Figure 3B:
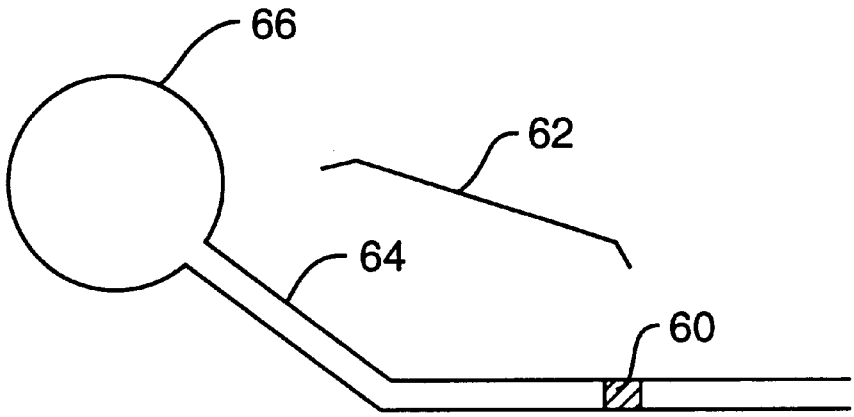
FIG. 3*b* shows a spoon having an upward angled handle.
Figure 3C:
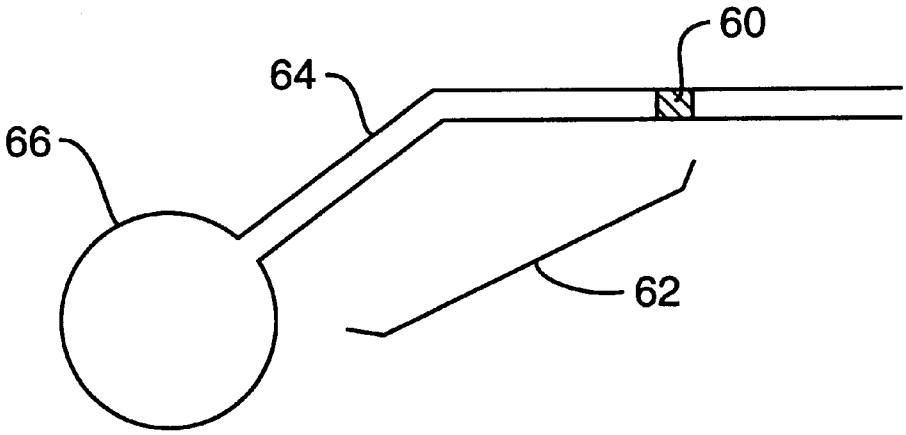
FIG. 3*c* shows a spoon having a downward angled handle.

Referring to FIGS. 3–3*c* a spoon is shown. The spoon 62 comprises a shaft 64 and a spoon head 66. Integrally molded into the shaft 64 is a notch 60. In the preferred embodiment, the shaft 64 is fitted into the bore 5 located at the second end of the handle 2. The release mechanism 10 then engages notch 60 as explained below. The head 66 of the spoon 62 can be any size.

FIGS. 3*b* and 3*c* show a top view of the spoon 62, wherein the shaft 64 is bent upward and downward at a certain angle, respectively. These upward and downward bends accommodate left and right handed eaters. That is, the downward bend depicted in FIG. 3*c* allows a right handed user to utilize the present invention with minimal wrist movement thus allowing a hand in "mid-position" to function in a table-to-mouth pattern. The upward bend depicted in FIG. 3*b* allows a left handed user to utilize the present invention with minimal wrist movement thus allowing the same hand in "mid-position" to function in a table-to-mouth pattern. The angle of either bend can vary according to the user's needs. For example, the angle may be 45 degrees for those individuals with some wrist flexibility, whereas a 75 degree angle is used for an individual with minimal wrist movement capabilities. In essence, the angle of the bend can vary from 1 to 180 degrees.

Figure 4:
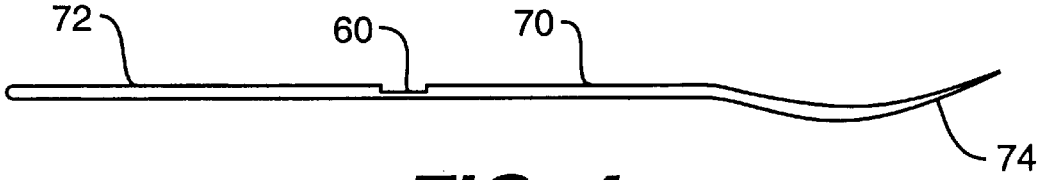
FIG. 4 shows a side view of a fork.
Figure 4A:
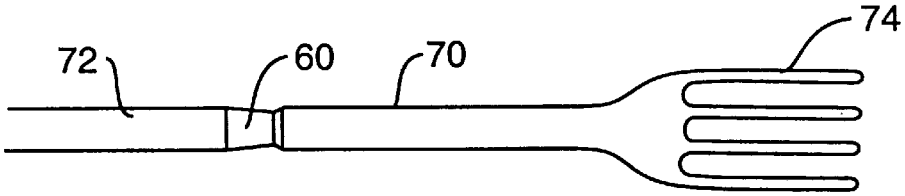
FIG. 4*a* shows a top view of a fork.
Figure 4B:
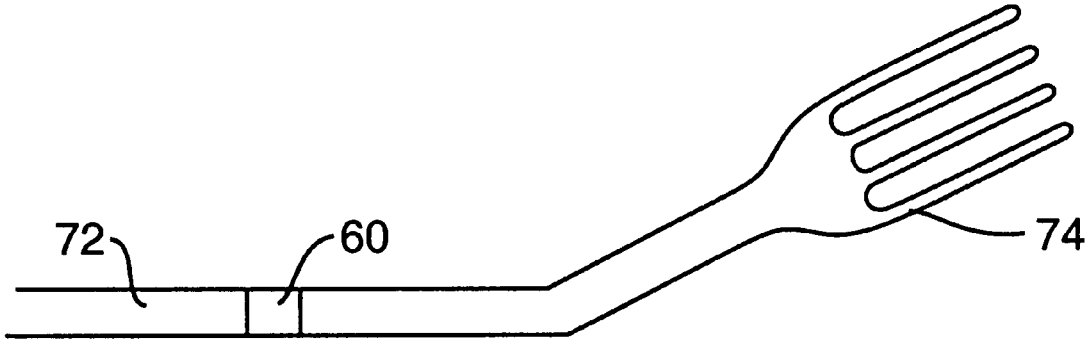
FIG. 4*b* shows a fork having an upward angled handle.
Figure 4C:
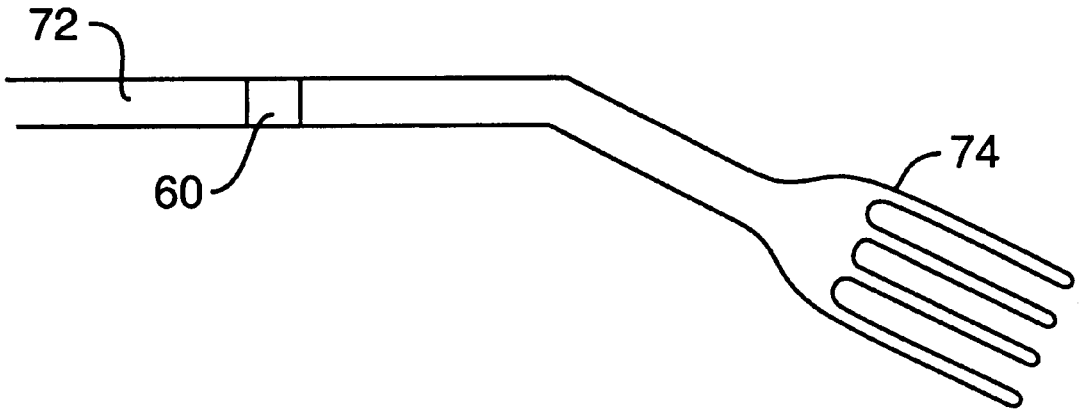
FIG. 4*c* shows a fork having a downward angled handle.

Referring to FIGS. 4–4*c* a fork is shown. The fork 70 comprises a shaft 72 and a fork head 74. Integrally molded into the shaft 72 is a notch 60. In the preferred embodiment, the shaft 72 is fitted into the bore 5 located at the second end of the handle 2. The release mechanism 10 then engages notch 60 as explained below. The head 74 of the fork 70 can be any size.

FIGS. 4*b* and 4*c* show a top view of the fork 70, wherein the shaft 72 is bent upward and downward at a certain angle, respectively. These upward and downward bends accommodate left and right handed eaters. That is, the downward bend depicted in FIG. 4*c* allows a right handed user to utilize the present invention with minimal wrist movement thus allowing the hand in "mid-position" to function in a table-to-mouth pattern. The upward bend depicted in FIG. 4*b* allows a left handed user to utilize the present invention with minimal wrist movement thus allowing the same hand in "mid-position" to function in a table-to-mouth pattern. As previously noted, the angle of either bend can vary according to the user's needs from 1 to 180 degrees.

Figure 5:
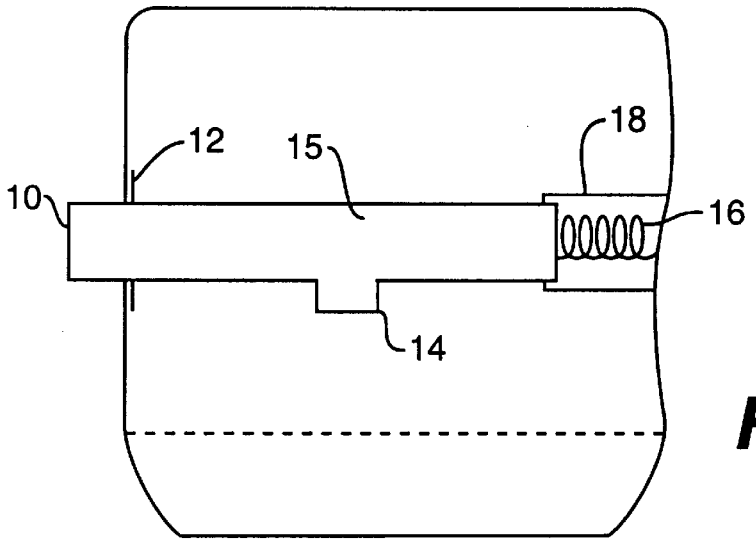
FIG. 5 shows a cutaway view of a release mechanism.

FIG. 5 shows a cutaway view of the release mechanism. In the preferred embodiment the release mechanism 10 is spring loaded and engages the notch 60 of the utensil 20 (e.g. fork or spoon). The release mechanism generally comprises a rod 15 having a first end and a second end. Depending downward from the rod 15 is a projection 14. This projection 14 engages the notch 60 of the utensil 20. The projection 14 locks or disengages the notch 60 of the utensil 20 so as to attach or detach the utensil 20 from the handle 2.

Situated at the second end of the rod 15 is a guide 18 and a spring 16. The guide 18 permits the rod 15 to travel in a defined path preferably perpendicular to the shafts 64 and 72 of the spoon 62 and fork 70, respectively (e.g. the utensils 20). The spring 16 acts as a reaction mechanism so that when the user disengages the release mechanism, the release mechanism automatically returns to its original position. A stopper 12 is also provided on the rod 15 in order to insure that the release mechanism does not extend past the guide 18 and deviate from the defined path.

FIG. 6 shows a front view of the second end of the handle 2. As seen, the second end of the handle 2 comprises a downward lip 3 and a bore 5 located substantially in the center of the handle 2. The shafts of the utensil 20 slip into the bore 5. Seen through the bore 5 is the downward projection 14 of the rod 15. This projection 14 engages the notches 60 of the utensil shafts 64 and 72. The stopper 12, guide 18, and spring 16 are also seen.

Figure 7:
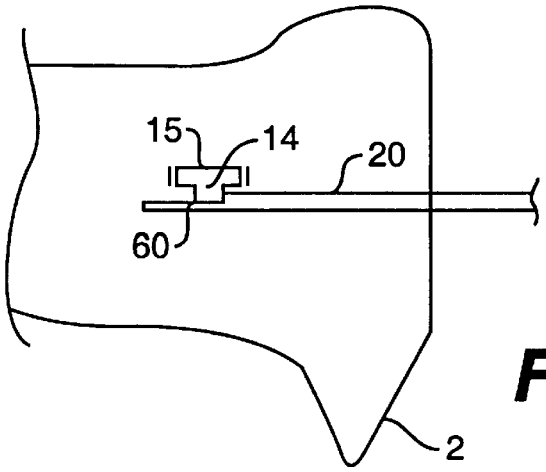
FIG. 7 shows a side cutaway view of the handle with the utensil engaged in the handle.

FIG. 7 shows a side cutaway view of the notch 60 of the utensil 20 with the utensil 20 fully engaged. In this embodiment, the downward projection 14 of the rod 15 engages the notch 60, thereby firmly coupling the utensil 20 to the handle 2.

In order to firmly attach the utensil 20 to the handle 2 a bore 5 and release mechanism 10 are utilized. As an example, to attach the spoon 62 to the handle 2 the user simply guides the shaft 64 into the bore 5 of the handle 2 until the downward projection 14 of the rod 15 engages the notch 60 of the spoon's 62 shaft 64. The spoon 62 is firmly attached to the handle 2 and ready for use once the notch 60 and downward projection 14 engage. The same procedure is used to attach the fork 70 (or other utensil) to the handle 2.

In order for the user to detach the spoon 62 from the handle 2 the user simply depresses the release mechanism 10 which, in turn, disengages the downward projection 14 of the rod 15 from the notch 60 on the shaft 64 of the spoon 62. Thereafter, the user removes the spoon 62 from the bore 5 of the handle 2. The release mechanism 10 will automatically return to its original position. The same procedure is used to remove the fork 70 (or other utensil) from the handle 2.

Figure 8:
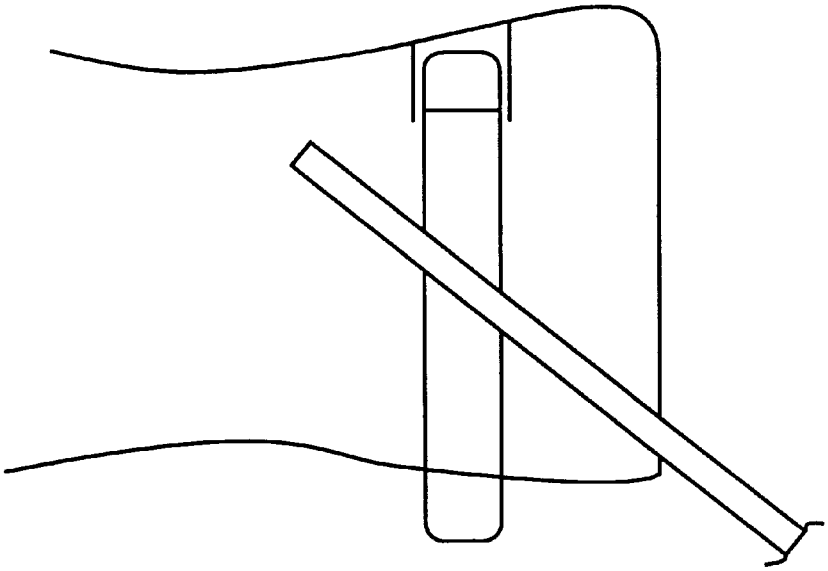
FIG. 8 shows the handle of the utensil placed at a downward angle.
Figure 9:
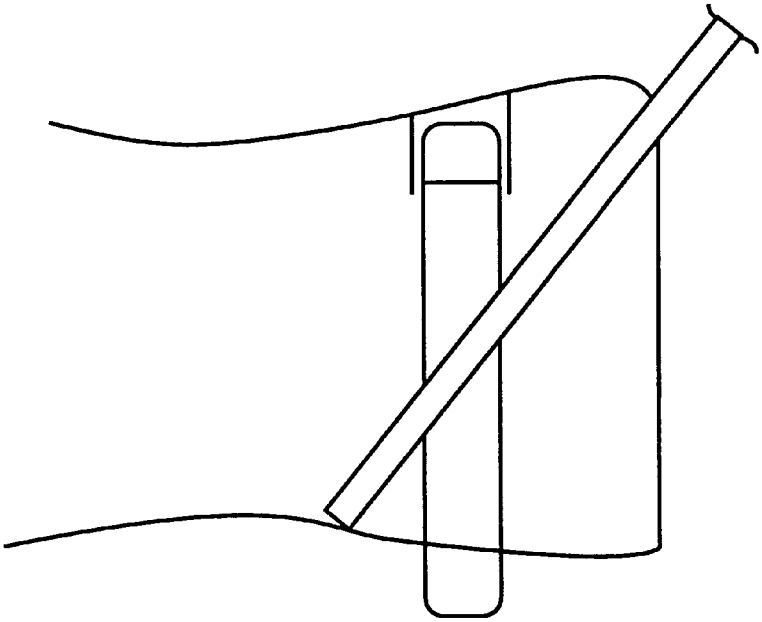
FIG. 9 shows the handle of the utensil placed at an upward angle.
Figure 10A:
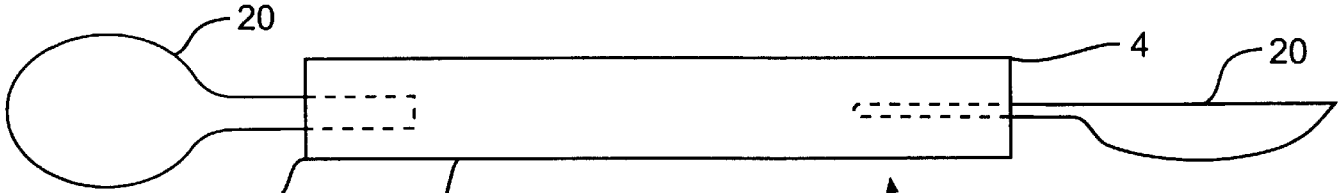
FIGS. 10A–10D shows the basic utensil tool with both ends having removable utensils, with FIG. 10A showing a spoon/knife.
Figure 10B:
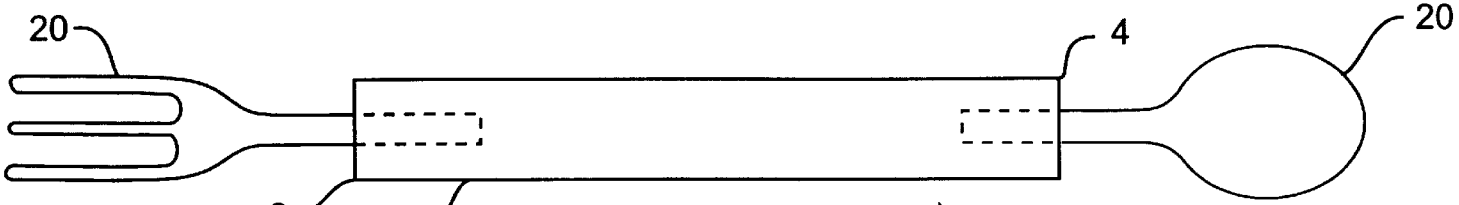
Figure 10C:
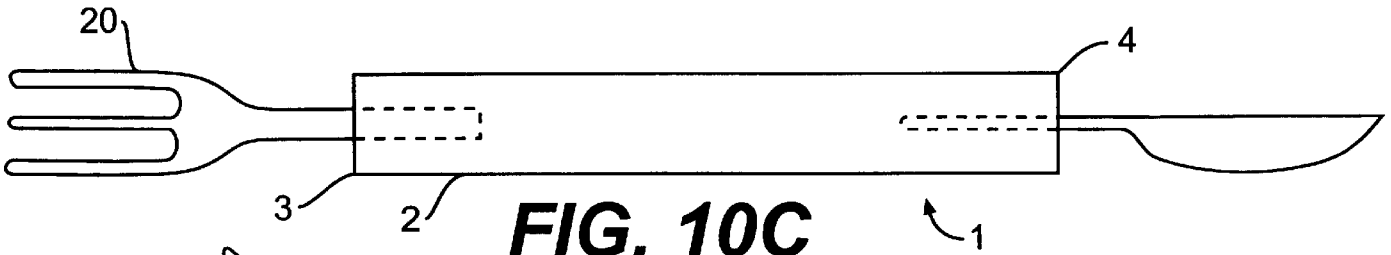
Figure 10D:
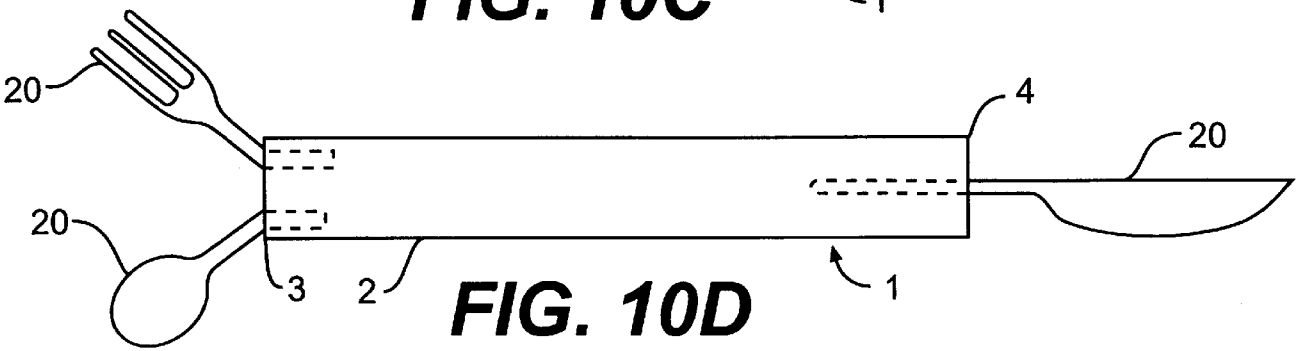

Alternate embodiments of the present invention comprise a utensil tip having a hexagonal pattern (or other shaped pattern) which fits into a hex hole (or other corresponding shaped hole) located on the handle and engages a retaining mechanism, e.g. a spring. This permits the user to attach and remove the utensils without a release mechanism. Other embodiments envision the bore 5 at other positions on the handle 2. For instance, instead of having angled utensils as shown in FIGS. 3*b*, 3*c*, 4*b*, and, 4*c*, the bore 5 is placed at different angles as shown in FIGS. 8 and 9. This helps left and right handed users utilize the present invention with minimal wrist movement. Other embodiments include the attachment of several utensils simultaneously such as, a spoon, fork, and knife.

FIGS. 10A–10D show some of the possible embodiments into which the detachable utensils 20 can be combined. Detachable utensils 20 of FIG. 10A form a knife/spoon combination. Detachable utensils 20 of FIG. 10B form a spoon/fork combination. Detachable utensils 20 of FIG. 10C form a knife/fork combination. Detachable utensils 20 of FIG. 10D form a knife/fork/spoon combination.

Preferred and alternate embodiments of the present invention have now been described in detail. It is to be noted, however, that this description of these specific embodiments is merely illustrative of the principles underlying the inventive concept. It is therefore contemplated that various modifications of the disclosed embodiments will, without departing from the spirit and scope of the invention, be apparent to persons skilled in the art. For instance, it is obvious to one skilled in the art of the present invention that alternate embodiments of the present combination utensil tool can include different shaped utensils.

We claim:

1. A combination utensil tool comprising:

(a) a handle having a first end and a second end, the handle having at least one bore at the second end;

(b) at least one utensil detachably mounted within the at least one bore of the second end of the handle; and (c) a knife having a shaft, the shaft is attached to the first end of the handle further comprising a spring loaded release mechanism having a rod and a downward extending projection wherein said rod is positioned so the downward projection at least partially intersects said at least one bore so as to releasably secure said at least one utensil.

2. The combination utensil tool of claim 1 wherein the handle further comprises contour for better fitting a user's hand.

3. The combination utensil tool of claim 1 wherein the handle further comprises additional padding for providing a better grip.

4. The combination utensil tool of claim 1 wherein the first end of the handle further comprises a raised rim.

5. The combination utensil tool of claim 1 wherein the second end of the handle comprises a lip.

6. The combination utensil tool of claim 1 wherein at least one utensil is selected from a group consisting of a fork and a spoon.

7. The combination utensil tool of claim 1 wherein the first end of the handle further comprises a first end bore, the shaft of the knife mounted in the bore.

8. The combination utensil tool of claim 7 wherein the shaft of the knife is permanently mounted to the first end of the handle.

9. The combination utensil tool of claim 1 wherein the shaft of the knife is removably mounted to the first end of the handle.

10. The combination utensil tool of claim 1 further comprising a spring loaded release mechanism proximate to the second end of the handle for retaining and releasing the shaft of the utensil.

11. The combination utensil tool of claim 1 wherein the bore is a hex-shaped hole for retraining the shaft of the utensil in the handle.

12. The combination utensil tool of claim 1 wherein the knife is a roller knife.

13. The combination utensil tool of claim 1 wherein the knife is a rocker knife.

14. The combination utensil tool of claim 1 wherein the shaft of the knife has a raised area having an upper and lower portion, and wherein the knife is mounted to the lower portion of the knife shaft so that it is slightly recessed in relation to the upper portion of the raised area.

15. The combination utensil tool of claim 1 wherein the shaft has an upper and a lower projection, and wherein the knife is mounted between the upper and lower projection.

16. The combination utensil tool of claim 1 wherein the utensil is removably mounted within the bore of the second end of the handle.

17. A combination utensil tool comprising:

(a) a handle having a first end and a second end, the handle having at least one bore at the second end;

(b) at least one utensil removably mounted within the at least one bore of the second end of the handle; and (c) a knife having a shaft, and wherein the shaft is rigidly fixed to the first end of the handle;

further comprising a spring loaded release mechanism having a rod and a downward extending projection wherein said rod is positioned so the downward projection at least partially intersects said at least one bore so as to releasably secure said at least one utensil.

18. The combination utensil tool of claim 17 wherein the at least one utensil has a shaft and a notch molded into the shaft, and wherein the shaft is removably mounted in the bore of the second end of the handle and the downward projection of the release mechanism engages the notch of the utensil.

19. The combination utensil tool of claim 17 wherein the handle is contoured to fit the user's hand.

20. The combination utensil tool of claim 17 wherein the handle further comprises additional padding for providing a better grip.

21. The combination utensil tool of claim 17 wherein the first end of the handle comprises a raised rim.

22. The combination utensil tool of claim 17 wherein the second end of the handle comprises a lip.

23. The combination utensil tool of claim 17 wherein the utensil is selected from a group consisting of a fork and a spoon.

24. The combination utensil tool of claim 17 wherein the knife is a roller knife.

25. The combination utensil tool of claim 17 wherein the knife is a rocker knife.

26. The combination utensil tool of claim 17 wherein the shaft of the knife has a raised area having an upper and lower portion, and wherein the knife is mounted to the lower portion of the knife shaft so that it is slightly recessed in relation to the upper portion of the raised area.

27. The combination utensil tool of claim 17 wherein the shaft has an upper and a lower projection, and wherein the knife is mounted between the upper and lower projection.

28. A combination utensil tool comprising:

(a) a handle having a first end and a second end, the first end having a raised rim and the second end having at least one bore and a lip;

(b) a spring loaded release mechanism, the spring loaded release mechanism proximate to the second end of the handle having a rod, a downward projection extending from the rod, a guide which permits the spring loaded release mechanism to travel in a defined path, and a stopper which insures that the spring loaded release mechanism does not extend past the guide;

(c) at least one utensil removably mounted within the bore of the second end of the hand, the utensil having a shaft and a notch molded into the shaft, and wherein the shaft is placed within the bore of the handle and wherein the downward projection of the spring loaded release mechanism engages the notch; and (d) a knife having a shaft attached to the first end of the handle.

29. The combination utensil tool of claim 28 wherein the utensil is selected from a group consisting of a spoon and a fork.

30. The combination utensil tool of claim 28 wherein the handle further comprises additional padding for providing a better grip.

31. The combination utensil tool of claim 28 wherein the shaft of the knife has a raised area having an upper and lower portion, and wherein the knife is mounted to the lower portion of the knife shaft so that it is slightly recessed in relation to the upper portion of the raised area.

32. The combination utensil tool of claim 28 wherein the knife is taken from the group consisting of roller knives and rocker knives.

33. A combination utensil tool comprising:

(a) a handle having a first end and a second end, the handle having at least one bore at the first end and at least one bore at the second end;

(b) at least one first utensil detachably mounted within the at least one bore of the first end of the handle; and (c) at least one second utensil detachably mounted within the at least one bore of the second end of the handle;

further comprising a spring loaded release mechanism having a rod and a downward extending projection wherein said rod is positioned so the downward projection at least partially intersects at least one of said at least one bores so as to releasably secure at least one of said at least one first and second utensils.

34. The combination utensil tool of claim 33, wherein the at least first utensil and at least second utensil form a combination selected from the group consisting of fork/knife, fork/spoon, and knife/spoon.

35. The combination utensil tool of claim 33, wherein a first end of the handle has two bores so as to allow a fork/spoon/knife utensil combination.

* * * * *